US005421776A

United States Patent [19]

Sakamoto et al.

[11] Patent Number: 5,421,776

[45] Date of Patent: Jun. 6, 1995

[54] EXHAUST AIR HOOD

[75] Inventors: Hiroshi Sakamoto, Kitami; Junzou Douken, Sapporo, both of Japan

[73] Assignee: Ube Trading Co., Ltd., Sapporo, Japan

[21] Appl. No.: 32,016

[22] Filed: Mar. 16, 1993

[30] Foreign Application Priority Data

Mar. 18, 1992 [JP] Japan ..... 4-062663

[51] Int. Cl.[6] ..... F24F 7/02; F23L 17/06

[52] U.S. Cl. ..... 454/368; 454/32

[58] Field of Search ..... 454/32, 39, 116, 163, 454/339, 367, 368

[56] References Cited

U.S. PATENT DOCUMENTS

| | | | |
|---|---|---|---|
| 164,636 | 6/1875 | Creamer | 454/116 |
| 1,097,387 | 5/1914 | Breidert | 454/116 |
| 1,336,470 | 4/1920 | McDonald | 454/116 |
| 1,435,913 | 11/1922 | Breidert | 454/116 |
| 1,645,283 | 10/1927 | Hansen | 454/116 |
| 2,813,473 | 11/1957 | Scherens | 454/116 |

FOREIGN PATENT DOCUMENTS 1-97145 6/1989 Japan .

*Primary Examiner*—Harold Joyce
*Attorney, Agent, or Firm*—Adduci, Mastriani, Schaumberg & Schill

[57] ABSTRACT

An exhaust air hood has a tubular body and at least one plate member having a chamber inside thereof. The plate member has a planar configuration including widths gradually decreasing toward two longitudinal ends of the plate member, the chamber having an opening at each longitudinal end of the plate member. The exhaust air hood discussed is capable of reducing backflows through exhaust air ports caused by wind pressure, thus enabling a proper ventilation system to be achieved.

9 Claims, 8 Drawing Sheets

FLOW VELOCITY WITHIN DUCT
(AT CENTRAL POSITON OF BUILDING WALL)

RELATIONSHIP BETWEEN EXTERNAL WIND VELOCITY $U_0$ AND FLOW VELOCITY $V_B$ WITHIN DUCT (OUTFLOW)

RELATIONSHIP BEIWEEN
QUANTITY Q OF EXHAUST AIR FLOW LOSS $h_W$

EXHAUST AIR HOOD

BACKGROUND OF THE INVENTION AND RELATED ARTS

The present invention relates to an exhaust air hood for use in air supply and exhaust systems for buildings and the like, and more specifically, to an exhaust air hood capable of reducing backflows into an interior which may be caused by external air flows.

In recent years, dwelling houses have become more and more air tight with a view, for instance, for improving the efficiency of sound insulation and heating. Particularly in cold areas, houses having a gap equivalent area ratio of less than 1 $cm^2/m^2$ is about to be realized.

In such highly air-tight houses, interior ventilation is important in order to realize a comfortable living environment, and development of ventilation systems fit for this purpose has been a strong concern.

In these circumstances, conventional ventilation systems fall into two types: mechanical air exhaust systems and mechanical air exhaust-and-supply systems.

In a conventional ventilation system, since the exhaust air port section is located outdoors, the ventilating function of the system is strongly influenced by external winds. Particularly when an exhaust air port happens to be positioned upwind of the system, the ventilating function is lowered, sometimes resulting in the occurrence of a backflow through the exhaust air port, thus failing to effect proper ventilation.

In the case of ventilation through the exhaust air port of a kitchen stove hood or ventilation for a bathroom or water-closet, there exists another problem. When the ventilation system is not in use, external air under wind pressure may flow indoors, causing contaminated air to diffuse into the interior.

The present invention is the result of extensive research conducted in view of the above-described problems. An object of the present invention is to provide an exhaust air hood capable of reducing backflows through exhaust air ports caused by wind pressure, thus enabling a proper ventilation system to be achieved.

SUMMARY OF THE INVENTION

The present inventor has conducted various studies to overcome the above-described problems, finding that, if an exhaust air hood has a hollow tubular body, and a hollow plate member of a specific configuration connected to the body at an angle, it is possible to cause a region having a pressure lower than the ambient pressure to be generated in the vicinity of the hood by utilizing an external air flow, and thus to overcome the problems. The present invention has been accomplished based on this finding.

According to the present invention, there is provided an exhaust air hood comprising a tubular body and at least one plate member having a chamber inside thereof. The plate member has a planar configuration including widths gradually decreasing toward two longitudinal ends of the plate member, the chamber having an opening at each longitudinal end of the plate member.

In the exhaust air hood according to the present invention, the tubular body and the plate member are connected at an angle. With this construction, an external air flow, due to wind or the like, enters into the plate member through the two openings at both longitudinal ends of the plate member. Then, the two streams of air are guided by the inner walls on either side of the plate member in such a manner that these two streams collide with each other at a central location of the plate member, and then flow round each other, thereby forming a rotational flow.

Since such a rotational flow formed inside the plate member is a forced vortex movement, a low-pressure region is generated at the central location. This is considered to result in air within the associated indoor space being drawn to the low-pressure region through the tubular body, and then discharged through a part of the above-mentioned end openings.

DETAILED DESCRIPTION OF THE PREFERRED EMBODIMENTS

The present invention will be described with respect to embodiments thereof with reference to the drawings.

Figure 1:
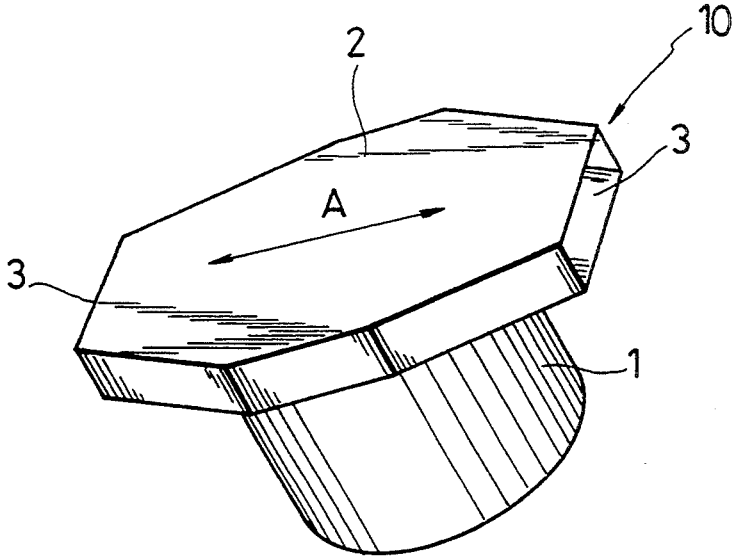
FIG. 1 is a perspective view showing an example of an exhaust air hood according to the present invention.

Referring to FIG. 1, a perspective view of an embodiment of the present invention, an exhaust air hood 10 according to the embodiment comprises a hollow tubular body 1 and a hollow plate member 2 that are connected in an angle. The plate member 2 has a certain planar configuration in which the width gradually decreases in the longitudinal direction of the plate member 2 (i.e., the direction indicated by arrow A in FIG. 1). In this embodiment, the plate member 2 has an octagonal configuration.

A pair of openings, capable of constituting exhaust air ports 3, is provided at two longitudinal ends of the plate member 2.

Figure 2:
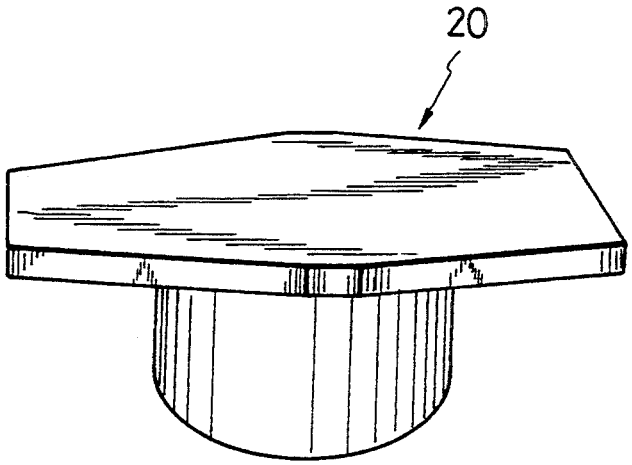
FIG. 2 is a perspective view showing another example of an exhaust air hood according to the present invention.
Figure 3:
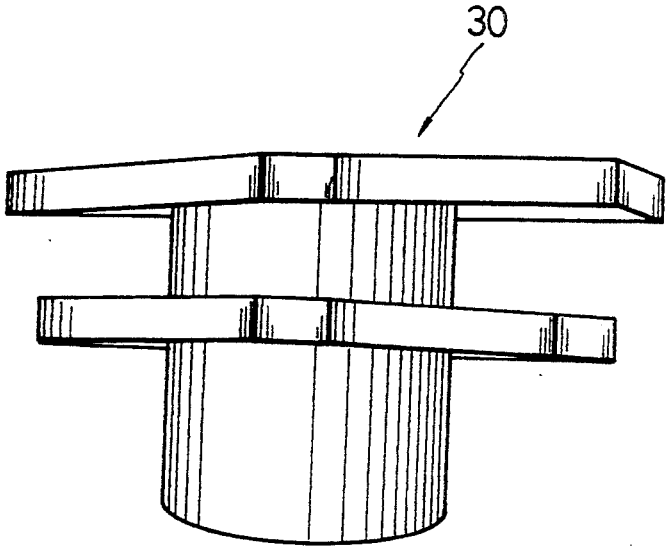
FIG. 3 is a perspective view showing still another example of an exhaust air hood according to the present invention.
Figure 4A:
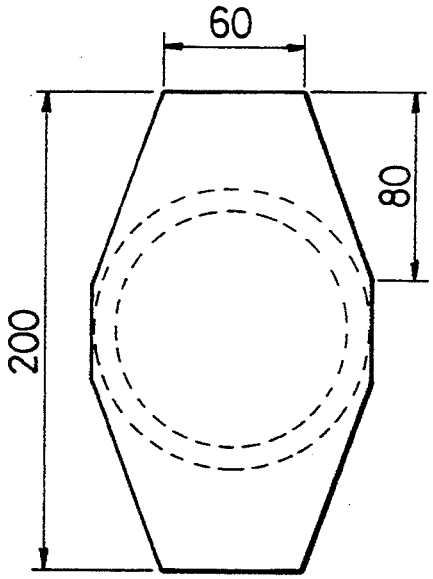
FIGS. 4A and 4B are a plan view and a side view, respectively, of the example presented in FIG. 1.
Figure 4B:
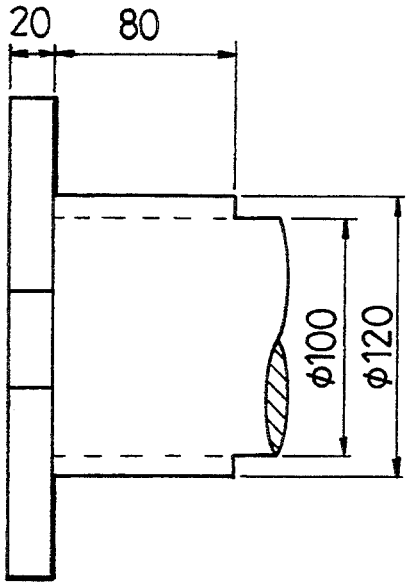
Figure 5A:
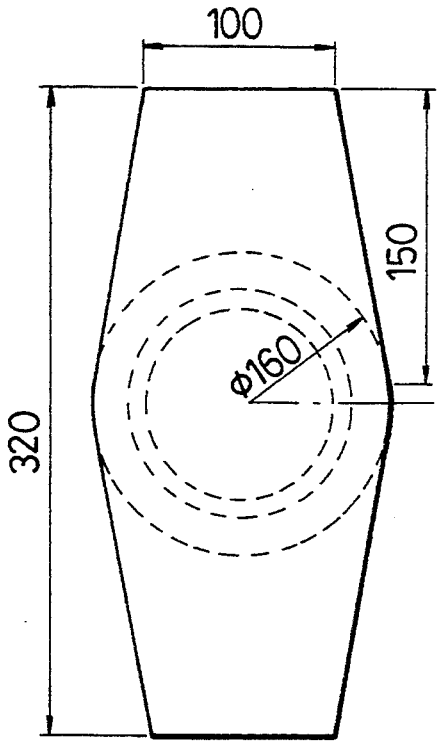
FIGS. 5A and 5B are a plan view and a side view, respectively, of the example presented in FIG. 2.
Figure 5B:
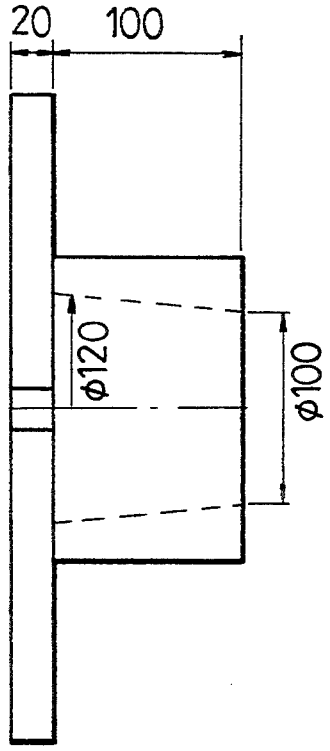
Figure 6A:
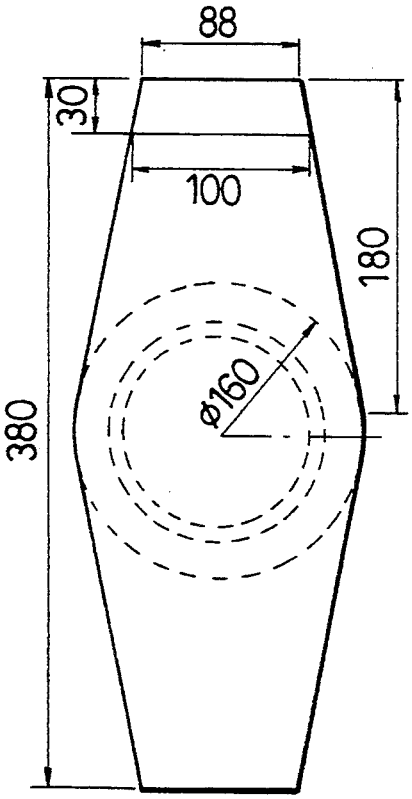
FIGS. 6A and 6B are a plan view and a side view, respectively, of the example presented in FIG. 3.
Figure 6B:
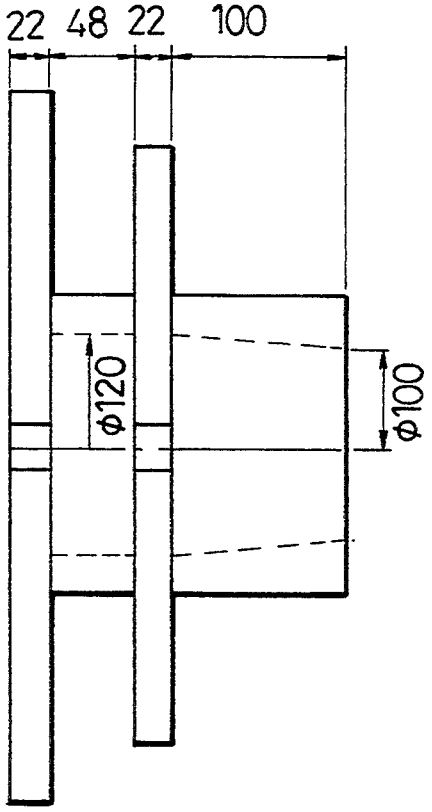

FIGS. 2 and 3 show other embodiments of the present invention. Exhaust air hoods 20 and 30 respectively shown in FIGS. 2 and 3 each has a hollow tubular body, a hollow plate member and exhaust air ports, as does the exhaust air hood 10. However, the hoods 20 and 30 are distinguished in that they have planar configurations different from that of the hood 10, and the hood 30 is further distinguished by the fact that it has two plate members. The hoods 10, 20 and 30 are shown in plan views and side views in FIGS. 4, 5 and 6, respectively. In FIGS. 4 through 6, various dimensions are indicated in millimeters.

Performance Evaluation Tests

The performance of exhaust air hoods 10, 20 and 30 and commercially available exhaust air hoods ("FP-100#" and "ASZ-100A") were evaluated as described herewith.

Evaluation of Backflow Reducing Effect

Houses used in these tests had sufficient air tightness and heat insulating characteristics, and had a length of 4 m, a depth of 2 m, a height of 3.8 m, and a floor area of 8 $m^2$. The tests also used a wind tunnel apparatus for generating external air flows, the apparatus including a tunnel with an air inlet cross-sectional area of 1.3 m×1.3 m. The apparatus was able to freely change the velocity of wind within a range from 0 to 10 m/s.

Figure 7:
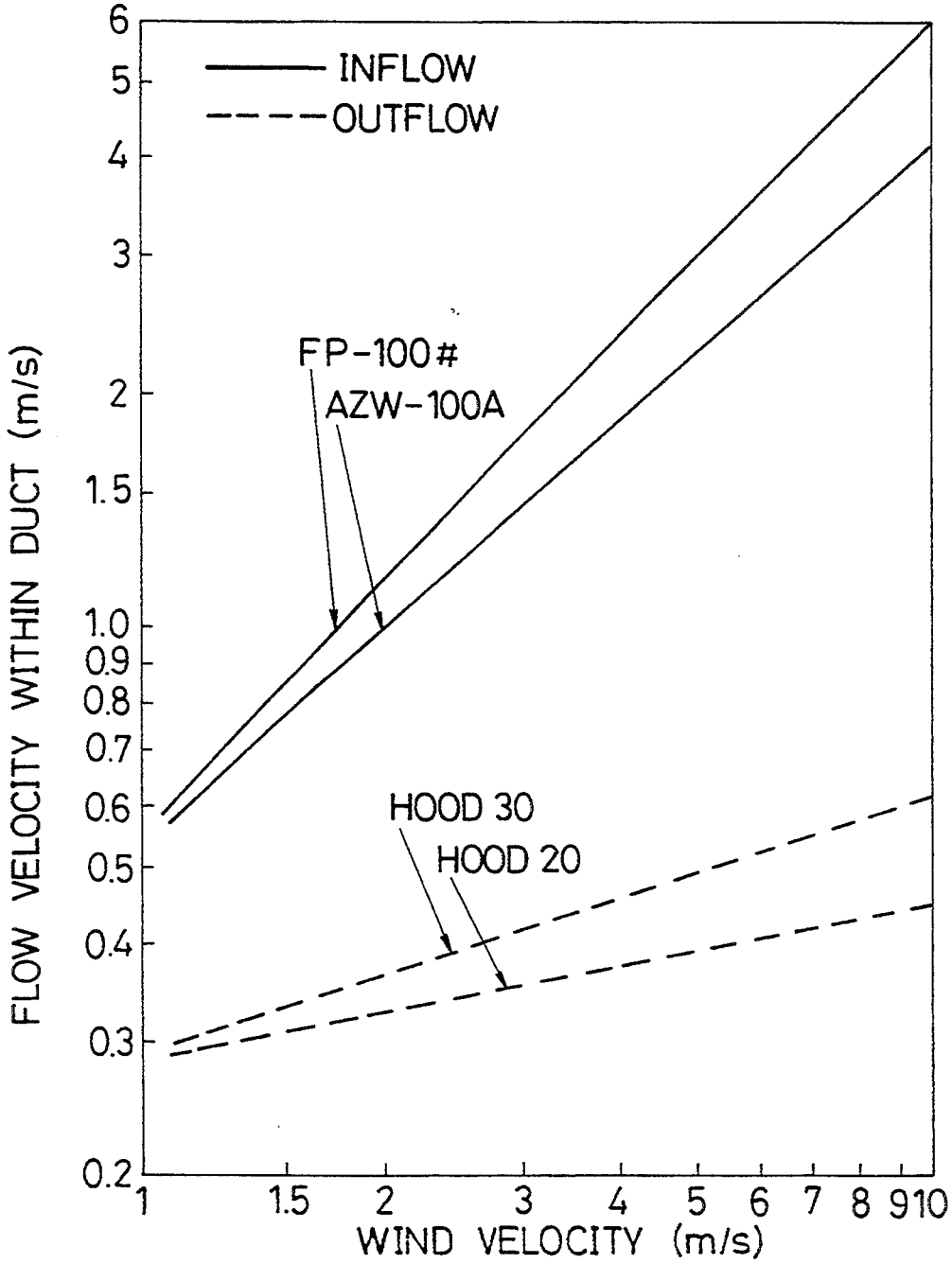
FIG. 7 is a diagram showing the backflow reducing effect of various exhaust air hoods.
Figure 8:
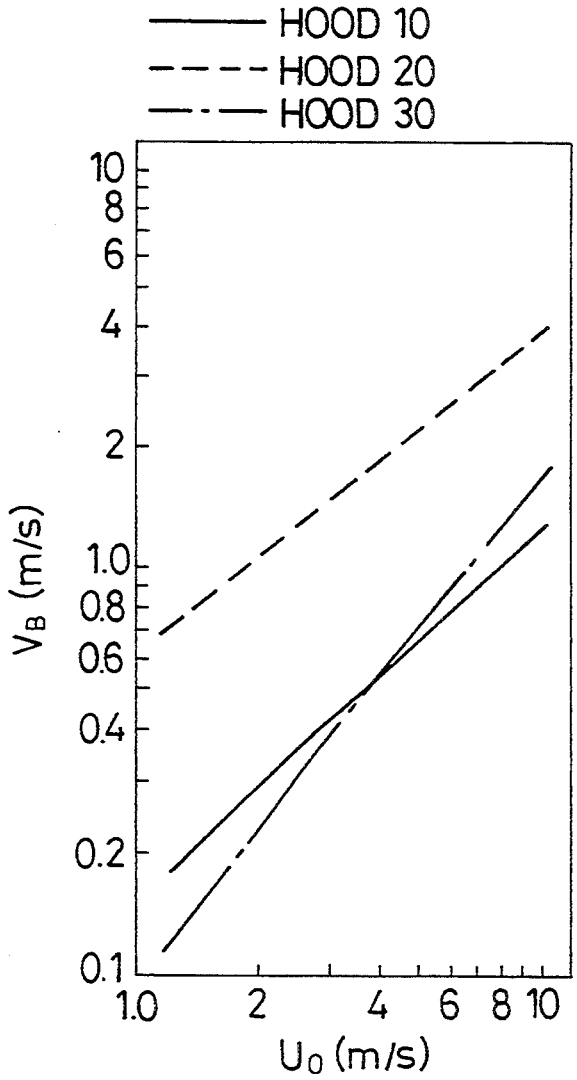
FIG. 8 is a diagram showing the backflow reducing effect of exhaust air hoods according to the present invention.

In the first group of tests, each exhaust air hood was connected to an indoor duct (length: 1.5 m; diameter: 100 mm), and were each set at a central position or at a peripheral position of a side wall located upwind of the house. Changes in the flow velocity within each duct (at the axial center of the duct) caused by changes in the wind velocity were measured. The results of this measurement are shown in FIG. 7 and FIG. 8.

Evaluation of Flow Loss

Each of various exhaust air hoods was mounted at one end of a pipe having a diameter of 100 mm and a length of 3 m, the other end of the pipe being mounted to the output side of an air blower. The flow loss of each exhaust air hood was evaluated by changing the quantity of flow within the associated pipe. The quantity of flow within each pipe was measured by using an orifice provided in an intermediate position of the pipe (according to Japanese Industrial Standards (JIS) Z8762-1988). The flow loss $h_w$ of each exhaust air hood is calculated on the basis of the following equation (Bernoulli equation):

$$p/\rho g+v_1{}^2 2g=p_o/\rho g+v_o{}^2 2g+h_w$$

where symbols p and v respectively represent pressure and flow velocity at a location immediately upstream of the hood inlet, and symbols $P_o$ and $v_o$ respectively represent pressure and flow velocity at a location immediately downstream of the hood outlet. The pressure $P_o$ corresponds to atmospheric pressure, the term $P_o=0$. Therefore, the flow loss $h_w$ of each exhaust air hood can be calculated from the following equation:

$$h_w=p/\rho g+(v_1{}^2-v_o{}^2)/2g$$

Figure 9:
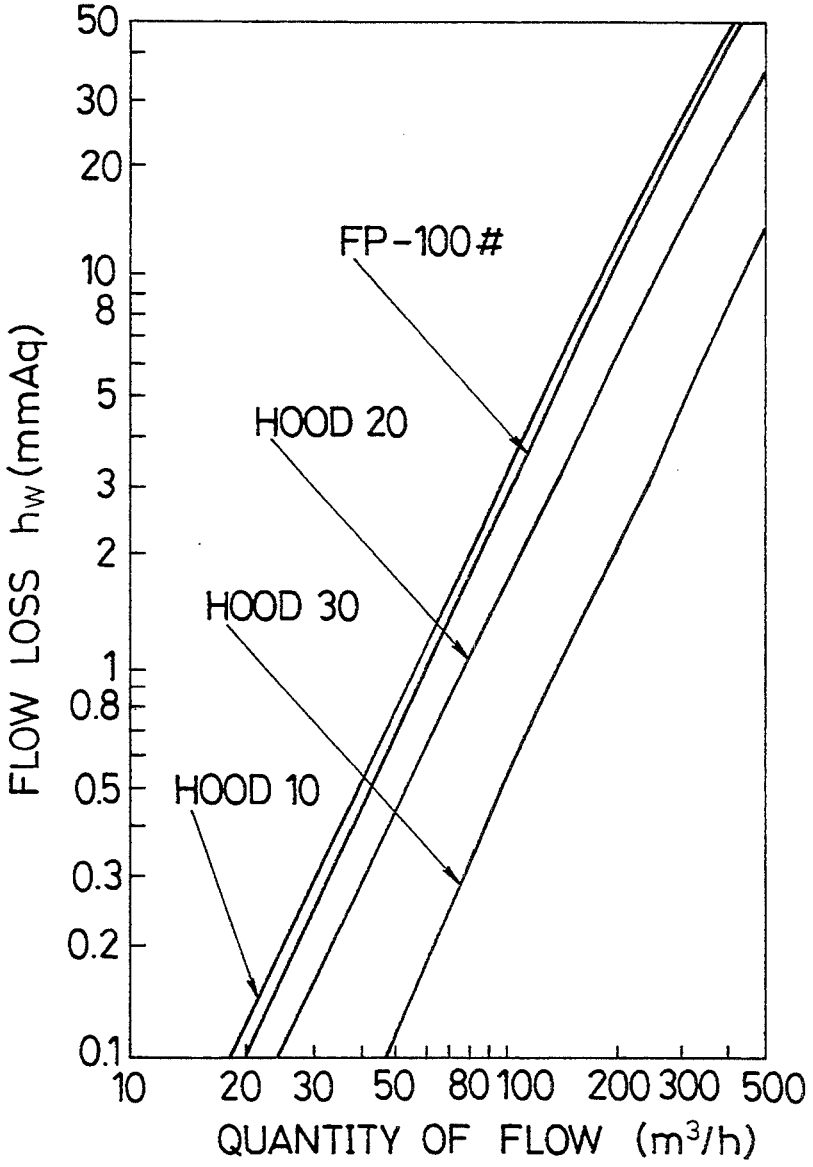
FIG. 9 is a diagram showing the flow loss of various exhaust air hoods.

The thus-obtained results are shown in FIG. 9.

Referring to FIGS. 7 to 9, it is seen that the exhaust air hoods 10, 20 and 30 have better performance than the commercially available products. Specifically, when the exhaust air hoods 20 and 30 are set at central positions of walls, these exhaust air hoods will involve no backflow even at a wind velocity of 10 m/s, and, on the contrary, is each able to permit air to flow outdoors at a slight velocity. This contrasts with the commercially available exhaust air hoods which, in the same condition, may involve backflow at every wind velocity, and let air flow at a maximum velocity of 6 m/s when the wind velocity is 10 m/s.

As seen from FIG. 8, when the exhaust air hoods, 10, 20 and 30 are set at positions (peripheral positions) deviated from the center of walls, such as above, each of these exhaust air hoods will permit air to flow outdoors at a substantial velocity. Thus, according to the present invention, wind force is utilized to cause air under a wind pressure, which might otherwise flow indoors as in a conventional system, to flow outdoors.

When the ventilation of, for example, 150 $m^3$ per hour (this corresponding to a ventilation amount necessary to a house of approximately 120 $m^3$) is taken into consideration, the value of flow loss corresponding to this quantity of flow is approximately 7 mmAq with respect to the commercially available exhaust air hood FP-100#, and that of the exhaust air hood 30 is approximately 1 mmAq, as shown in FIG. 9. The latter value is substantially smaller than the former value, thus proving that the exhaust air hood according to the present invention has excellent performance also in terms of fluid dynamics. This feature is very important in constructing a mechanical ventilation system, and it can be said that an exhaust air hood according to the present invention involves smaller hindrance to the function of the associated exhaust fan than a commercially available exhaust air hood.

Next, the operation of the first embodiment will be described.

Figure 10:
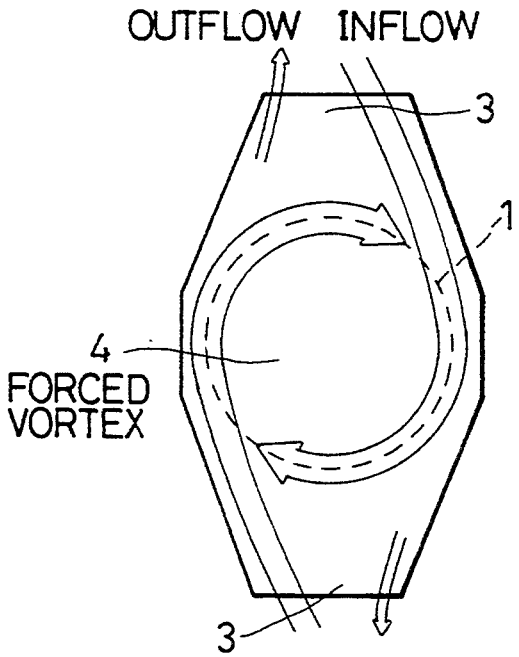
FIG. 10 is an explanatory view showing the flow of air within an exhaust air hood according to the present invention set at a central position of a building wall.

In the previously described embodiment, the hollow plate member 2 having an octagonal planar configuration is connected to the hollow tubular body 1 perpendicular to the axis of the tubular body 1. With this construction, therefore, when an external air flow enters forming two streams (indicated by thick arrows in FIG. 10) passing through the exhaust air ports 3 at either longitudinal ends of the plate member 2, the streams collide with each other at a central location 4 of the plate member 2, and flow round each other, thereby forming a rotational flow. Since such a rotational flow formed inside the plate member 2 is a forced vortex movement, a low-pressure region is generated at the central location 4. It is considered that, in consequence, indoor air is drawn through the tubular body 1 to the low-pressure region 4, and then discharged through a part of the opening area defined by the ports 3, as indicated by thin arrows.

Figure 11:
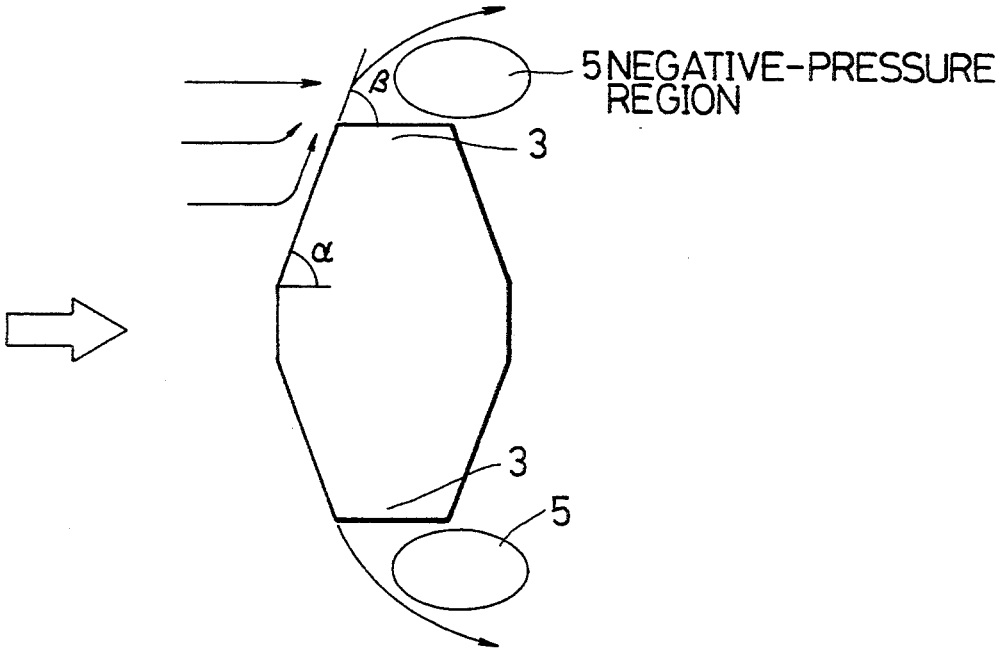
FIG. 11 is an explanatory view showing the flow of air obtainable with an exhaust air hood according to the present invention set at a peripheral position of a building wall.

The following is considered to be the reason setting an exhaust air hood according to the present invention at a peripheral position on an upwind wall of a building provides good backflow-reducing effect. As shown in FIG. 11, portions of an air flow, which have branched off at a central location of an upwind side wall of the houses flow along the side wall, as indicated by thin arrows, and then separate from the upstream corners of the exhaust air ports 3, thereby forming a strong negative-pressure region 5 in the vicinity of each exhaust air port 3. This helps indoor air to flow outdoors. Thus, with an exhaust air hood according to the present invention, the presence of wind makes it possible to increase the exhaust amount of the associated exhaust fan, and enables natural exhausting.

An example of a manner of setting an exhaust air hood according to the present invention will be described.

Figure 12:
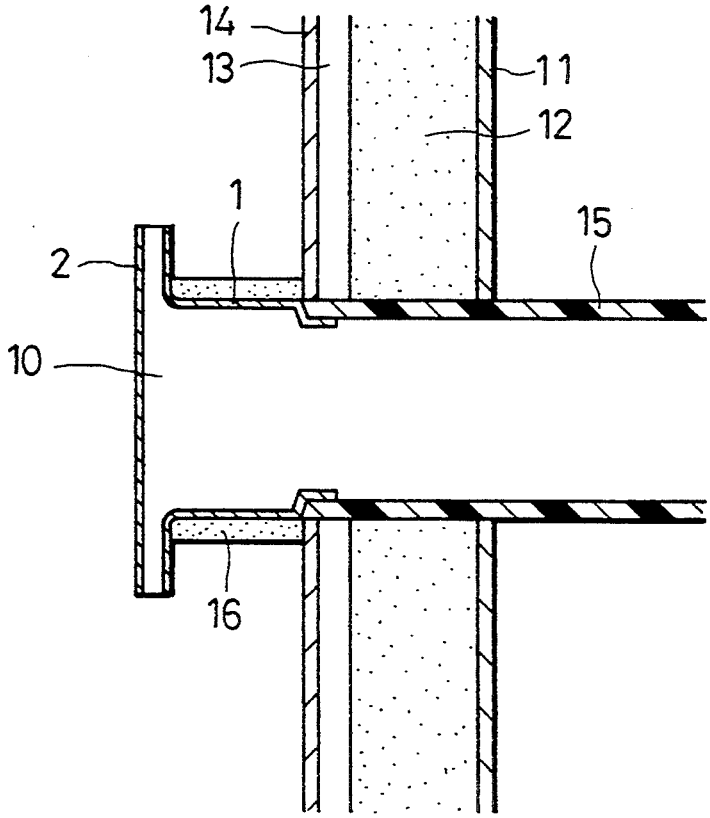
FIG. 12 is a cross sectional explanatory diagram showing an example of a manner of setting an exhaust air hood according to the present invention.

FIG. 12 is a sectional view showing an example of an exhaust air hood setting manner. Referring to FIG. 12, the exhaust air hood 10 is mounted on the outer end of a tubular member 15 (made of, for example, a polyvinyl chloride material) passing through an interior finish layer 11, a heat insulating layer 12, an aeration layer 13 and an outer wall layer 14. The inner end of the tubular member 15 is connected to the output of an exhaust fan, not shown. The tubular body 1 of the exhaust air hood 10 is surrounded by a heat insulating material layer 16. The distance between the plate member 2 and the outer wall layer 14 may be suitably varied in accordance with the place of setting, etc.; however, a distance of 8 to 10 cm is preferable.

Although the present invention has been described with respect to embodiments thereof, the present invention is not intended to be limited to the embodiments, and various changes may be made within the scope of the gist of the present invention. For example, the dimensions and the like of the plate member and the tubular member may be suitably varied in accordance with the intended backflow reducing effect, etc. Further, the plate member may have any planar configuration so long as the width gradually decreases toward the longitudinal ends of the plate member, and the planar configuration may be, for example, elliptic or rhombic.

In addition, the number of plate members may alternatively be three or greater.

An exhaust air hood of the present invention can be applied to not only the ventilation of dwellings but also to other cases of ventilating a defined space, such as a vehicle, an aircraft or the like.

As has been described above, an exhaust air hood according to the present invention has a hollow tubular body, and a hollow plate member with a specific configuration connected to the tubular body perpendicular to the axis thereof. Therefore, the exhaust air hood is able to reduce backflows through exhaust air ports which may be caused by wind pressure, and thus enables a proper ventilation system to be achieved.

In addition, the exhaust air hood according to the present invention does not over work the exhaust fan and effectively follows the energy conserving tendency of recent years.

What is claimed is:

1. An exhaust air hood comprising:

a tubular body; and a hollow plate member connected to said tubular body at a predetermined angle and being in fluid communication with said tubular body, said hollow plate member having a top plate, a bottom plate, opposing side walls connecting said top and bottom plates, and first and second open ends, said first and second open ends being aligned at opposite ends of said hollow plate member and a width of said top and bottom plates gradually decreasing toward said first and second open ends so that air entering said hollow plate member through said first and second open ends is induced to flow in a swirling flow pattern in a central portion of said hollow plate member.

2. The exhaust air hood of claim 1, wherein said hollow plate member is connected to said tubular body so that said hollow plate member is substantially perpendicular to an axis of said tubular body.

3. The exhaust air hood of claim 2, wherein said plate member has a planar configuration selected from the group consisting of four, six, and eight sided polygonal shapes.

4. The exhaust air hood of claim 3, wherein said hollow plate member has an octagonal configuration.

5. The exhaust air hood of claim 1, wherein said opposing side walls are symmetrical.

6. The exhaust air hood of claim 5, wherein portions of said opposing side walls are linear.

7. The exhaust air hood of claim 6, wherein diametrically opposed portions of said opposing side walls are parallel to each other.

8. The exhaust air hood of claim 1, wherein said tubular body is connected to an interior portion of a fixed, immovable structure.

9. The exhaust air hood of claim 8, wherein said fixed, immovable structure is a building.

* * * * *